US008413339B2

(12) United States Patent
Ranieri et al.

(10) Patent No.: US 8,413,339 B2
(45) Date of Patent: Apr. 9, 2013

(54) QUICK CHANGE SNAP OFF KNIFE

(75) Inventors: Eric Ranieri, Besancon (FR); Stephen Rowlay, Sheffield (GB); Brian Keers, Terryville, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 13/020,674

(22) Filed: Feb. 3, 2011

(65) Prior Publication Data

US 2012/0198703 A1 Aug. 9, 2012

(51) Int. Cl.
*B26B 1/08* (2006.01)

(52) U.S. Cl.
USPC ..... 30/162; 30/335; 30/337; 30/339

(58) Field of Classification Search ..... 30/162, 30/320, 329, 335, 337, 339; D8/98, 99, 105, D8/107
See application file for complete search history.

(56) References Cited

U.S. PATENT DOCUMENTS

| | | | | | |
|---|---|---|---|---|---|
| 3,439,419 | A | * | 4/1969 | Fleming | 30/162 |
| 3,448,518 | A | | 6/1969 | Sklar | |
| 3,765,089 | A | * | 10/1973 | Ibata | 30/320 |
| 3,857,176 | A | * | 12/1974 | Quenot | 30/162 |
| 4,089,112 | A | | 5/1978 | Richards | |
| 4,103,421 | A | * | 8/1978 | Quenot | 30/320 |
| 4,170,062 | A | * | 10/1979 | Machida | 30/162 |
| 4,196,515 | A | * | 4/1980 | Sugiyama | 30/335 |
| 4,200,977 | A | | 5/1980 | Kageyama et al. | |
| 4,209,900 | A | * | 7/1980 | Gilbert | 30/162 |
| 4,226,020 | A | | 10/1980 | Quenot et al. | |
| 4,232,445 | A | * | 11/1980 | Ito | 30/162 |
| 4,233,734 | A | * | 11/1980 | Bies | 30/162 |
| 4,240,202 | A | * | 12/1980 | Gilbert | 30/162 |
| RE30,733 | E | * | 9/1981 | Quenot | 30/335 |
| 4,292,738 | A | * | 10/1981 | Osada | 30/162 |
| 4,322,885 | A | * | 4/1982 | Osada | 30/320 |
| 4,517,741 | A | * | 5/1985 | Castelluzzo | 30/162 |

(Continued)

FOREIGN PATENT DOCUMENTS

| | | | |
|---|---|---|---|
| EP | 2153948 | A2 * | 2/2010 |
| FR | 2 585 979 | | 2/1987 |

(Continued)

OTHER PUBLICATIONS

Search Report and Search Opinion as issued for European Patent Application No. 12153709.6, dated May 30, 2012.

*Primary Examiner* — Jason Daniel Prone
(74) *Attorney, Agent, or Firm* — Pillsbury Winthrop Shaw Pittman LLP

(57) ABSTRACT

A knife having a body and a slide member slideable in the body. The slide member engages a blade assembly that is arranged to move with the slide member. The slide member is movable to position the blade assembly at a position of use and a release position wherein the blade assembly can be released from the slide member. The slide member is movable to retract the blade assembly into the knife body. The knife also includes an actuator member that can be actuated to move the slide member to a disengaged configuration wherein the blade assembly can be disengaged from the slide member to permit the release therefrom. The positioning of the blade assembly at the release position and subsequent movement of the slide member to the disengaged configuration by actuation of the actuator member releases the blade assembly from the slide member.

21 Claims, 9 Drawing Sheets

U.S. PATENT DOCUMENTS

| | | | | | |
|---|---|---|---|---|---|
| 5,025,558 | A * | 6/1991 | Gilbert | 30/162 |
| 5,269,063 | A | 12/1993 | Okada | |
| 5,502,896 | A | 4/1996 | Chen | |
| 5,584,123 | A * | 12/1996 | Chi | 30/335 |
| D386,959 | S | 12/1997 | Okada | |
| D399,114 | S | 10/1998 | Okada | |
| 5,906,050 | A * | 5/1999 | Gilbert | 30/162 |
| D412,654 | S * | 8/1999 | Gilbert et al. | D8/99 |
| D412,655 | S * | 8/1999 | Gilbert et al. | D8/99 |
| D412,822 | S * | 8/1999 | Gilbert et al. | D8/99 |
| D431,170 | S | 9/2000 | Okada | |
| 6,226,873 | B1 | 5/2001 | Okumura | |
| 6,484,404 | B1 * | 11/2002 | Kao | 30/162 |
| 6,510,612 | B1 | 1/2003 | Cybulski | |
| 6,532,670 | B1 | 3/2003 | Berns | |
| 6,708,410 | B2 * | 3/2004 | Okada | 30/162 |
| 6,718,640 | B1 | 4/2004 | John | |
| 6,745,474 | B1 * | 6/2004 | Huang | 30/335 |
| 7,028,406 | B2 * | 4/2006 | Polei | 30/162 |
| D523,316 | S | 6/2006 | Kondo et al. | |
| 7,107,687 | B2 * | 9/2006 | Okada | 30/335 |
| 7,434,317 | B2 * | 10/2008 | Levine et al. | 30/335 |
| 7,784,189 | B2 * | 8/2010 | Polei | 30/335 |
| 7,921,568 | B2 * | 4/2011 | Green | 76/104.1 |
| 2002/0096032 | A1 * | 7/2002 | Peyrot et al. | 30/339 |
| 2003/0009887 | A1 | 1/2003 | Cybulski | |
| 2006/0185172 | A1 | 8/2006 | Marshall et al. | |
| 2008/0256808 | A1 * | 10/2008 | Levine et al. | 30/162 |
| 2009/0277016 | A1 * | 11/2009 | Wu | 30/162 |
| 2011/0283542 | A1 * | 11/2011 | Wu | 30/162 |
| 2012/0073143 | A1 * | 3/2012 | Honda | 30/162 |

FOREIGN PATENT DOCUMENTS

| | | |
|---|---|---|
| GB | 2 003 781 | 3/1979 |
| GB | 2 039 814 | 8/1980 |
| IT | 1128217 B * | 5/1986 |

* cited by examiner

QUICK CHANGE SNAP OFF KNIFE

FIELD OF THE INVENTION

The present invention relates generally to cutting devices, and, more particularly to utility knives.

BACKGROUND OF THE INVENTION

Cutting devices, such as utility knives, have been developed for use in various applications, such as, for example, construction, packaging and shipping, carpet installation, as well as other purposes.

Some utility knives include a handle carrying a blade assembly comprising a plurality of snap-off blades. A slider carrying the blade assembly can be moved to extend at least the leading blade from one end of the handle. A plurality of break-lines formed in the blade assembly facilitate the snapping off of a used snap-off blade (e.g., that has become blunt or damaged through usage) from the snap-off blade assembly.

However, replacing the blade assembly and replacing it with a new one may be cumbersome.

SUMMARY OF THE INVENTION

One aspect provides a knife having a body having a first end, a second end, and an opening at the first end. The knife also includes a slide member constructed and arranged to be slideable in the body. The slide member is arranged to engage a blade assembly that comprises a plurality of releasably attached blade members that can be separated from one another. The blade assembly comprises an engagement opening and the slide member includes an engagement structure that is arranged to engage the engagement opening so that the blade moves with the slide member. The slide member is moveable to position the blade assembly at a position of use wherein at least one of the blade members has at least a portion thereof that projects from the opening at the first end, and to position the blade assembly at a release position wherein the blade assembly can be released from the slide member when at the release position. The slide member is further operable to retract the blade assembly into the body towards the second end to a retracted position. An actuator member is constructed and arranged to be actuated to thereby move the slide member to a disengaged configuration wherein the blade assembly can be disengaged from the slide member to permit the release therefrom. The positioning of the blade assembly at the release position and subsequent movement of the slide member to the disengaged configuration by actuation of the actuator member releases the blade assembly from the slide member.

Another aspect provides a method for replacing a blade assembly of a knife. The knife comprises a body having a first end, a second end, and an opening at the first end. The knife further comprises a slide member constructed and arranged to be slideable in the body, the slide member arranged to engage a blade assembly that comprises a plurality of releasably attached blade members that can be separated from one another, and an actuator member operatively connected to the slide member. The method includes the step of moving the slide member to position the blade assembly at a release position wherein the blade assembly can be released from the slide member. The method also includes actuating the actuator member to move the slide member to a disengaged configuration. The method further includes disengaging the blade assembly from the slide member to release the blade assembly therefrom.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein can be considered drawn to scale. It is to be expressly understood, however, that the drawings are for the purpose of illustration and description only and are not a limitation of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

DETAILED DESCRIPTION OF THE INVENTION

Figure 1A:
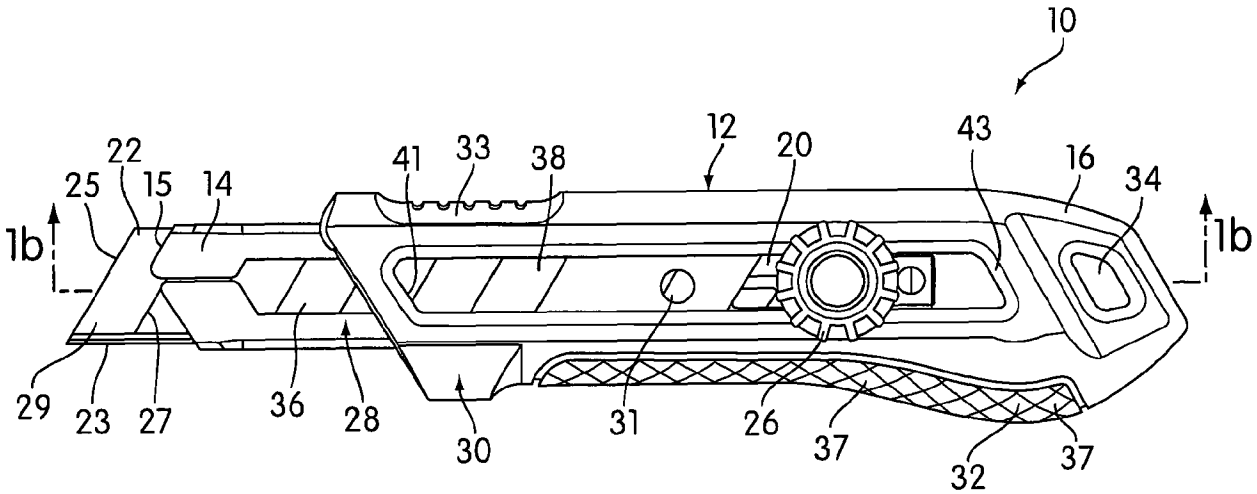
FIG. 1*a* is a side plan view of the knife assembly in an operative position in accordance with an embodiment.

FIG. 1*a* shows a knife 10 in accordance with one embodiment that includes a body 12 having a first end 14, a second end 16, and an opening 15 at the first end 14. An interior space 18 (see FIG. 1*b*) may be provided between the first end 14 and the second end 16. A slide member 20 is constructed and arranged to be slideable in the body 12. The slide member 20 is arranged to engage a blade assembly 22 that comprises a plurality of releasably attached blade members 29 that can be separated from one another. The blade assembly 22 includes an engagement opening 31 and the slide member 20 includes an engagement structure 56 (see FIG. 1*b*) that is arranged to engage the engagement opening 31 so that the blade assembly 22 moves with the slide member 20. The slide member 20 is operable to position the blade assembly 22 at a position of use wherein at least one of the blade members 29 has at least a portion thereof that projects from the opening 15 at the first end 14, a retracted position, and a release position wherein the blade assembly 22 can be released from the slide member 20 when at the release position. In one embodiment, at the release position, the blade assembly 22 is disposed near or at the opening 15 of the first end 14 of the body 12. The slide member 20 is further operable to retract the blade assembly 22 into the body 12 towards the second end 16. In one embodiment, the knife 10 also includes a bias member 24 constructed and arranged to bias the slide member 20 toward an engaged configuration wherein the blade assembly 22 is engaged to the sliding member 20 to prevent release therefrom. An actuator member 26 is constructed and arranged to be actuated to thereby move the slide member 20 to a disengaged configuration wherein the blade assembly 22 can be disengaged from the slide member 20 to permit the release therefrom. Accordingly, the positioning of the blade assembly 22 at the release position and subsequent movement of the slide member 20 to the disengaged configuration by actuation of the actuator member 26 releases the blade assembly 22 from the slide member 20.

Figure 1B:
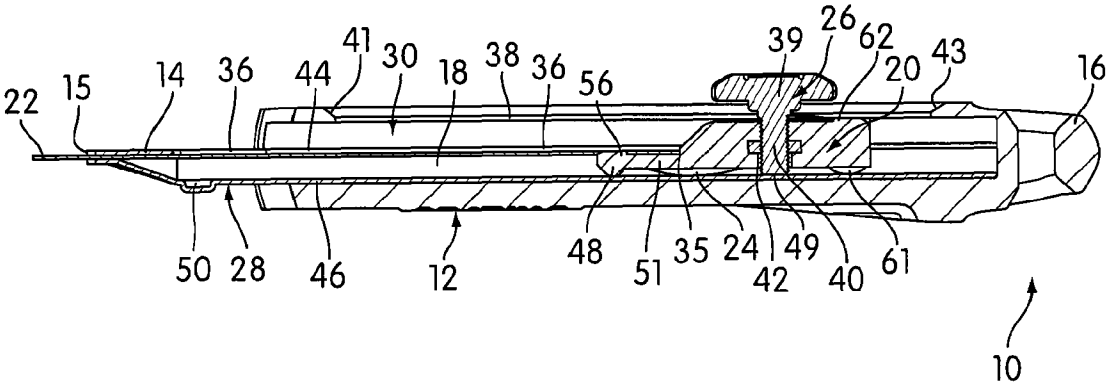
FIG. 1*b* is a cross sectional view of the knife assembly, taken through the line x-x in FIG. 1*a*, in an operative position of use.

In the embodiment shown in FIG. 1*a*, the body 12 of the knife 10 includes a barrel 28 and a body portion 30. The body portion 30 is constructed and arranged to receive the barrel 28 therewithin. In one embodiment, the barrel 28 is constructed and arranged to be connected to the body portion 30 using a threaded or other type of conventional fasteners. However, other connecting mechanisms may be used, such as, just for example, adhesives. In one embodiment, the barrel can be selectively removable from the body portion 30. As shown in FIG. 1*b*, the barrel 28 includes a first side 44 and an opposing second side 46. The blade assembly 22 may be disposed near (or slideably in contact with) the first side 44.

Referring back to FIG. 1*a*, a lower portion 32 of the body portion 30 is contoured or arranged to more comfortably accommodate the fingers of the user. An upper portion 33 may be contoured or arranged to comfortably accommodate the thumb of the user. The lower portion 32 of the body portion may be provided with grooves 37 to facilitate the grasping of the knife 10. In one embodiment, the body portion 30 of the knife 10 is made from a plastic material to provide light weight, and corrosion resistance. Alternatively or additionally, the body portion 30 of the knife 10 may also be made of metal. In one embodiment, the lower portion 32 and/or other portions of the body portion 30 (e.g., the upper portion 33) may also include an elastomeric material, foam, rubber, other materials, or any combination thereof to provide a user's palm with a comfortable gripping surface. Alternatively or additionally, a gripping material may be attached to the body portion 30 using attachment mechanisms such as, but not limited to, welding, fastening, friction fitting, snap fitting, or adhesive bonding. Alternatively or additionally, the gripping material may be a coating provided on the surface of the body portion 30. For example, in one embodiment, the body portion 30 may be made of a suitable molded plastic material and may be coated with a layer of an elastomeric material, such as a rubber based material. In one embodiment, the barrel 28 is made of steel material. However, it should be appreciated that the barrel 28 may be made of metals, plastic, or other materials or a combination of materials.

The blade assembly 22 may take the form of an elongated flat, thin strip which is sharpened along a lower edge 23 with the point of the blade being formed by the intersection of the lower edge 23 and an inclined front edge 25. The blade assembly 22 may also include a rear edge 35 (see FIG. 1*b*) at an end opposite the inclined front edge 25. In one embodiment, the blade assembly 22 is made of steel material. The blade assembly 22 is formed with a series of score lines 27 parallel to the front edge 25 so that when a sharp new edge 23 is desired, this can be obtained by snapping off a forward blade member 29 of the blade assembly 22 at the leading score line 27. The blade assembly 22 may include an engagement structure, such as in the form of an opening 31, at or near the rearward portion of the blade assembly 22, opposite the front edge 25. The opening 31 may be used to mount the blade assembly to the slide member 20.

In the embodiment shown in FIG. 1*a*, an elongated opening 36 is formed in the first side 44 of the barrel 28 and a corresponding elongated opening 38 is formed in the body portion 30 to enable the actuator member 26 to slide with the slide member 20 along the knife body 12. The body portion 30 may include a first stop surface 41 defining a front portion of the opening 38 and a second side 43 defining a rear portion of the opening 38. As shown in FIG. 1*b*, the actuator member 26 includes a head portion 39 and a body portion 40. In the illustrated embodiment, the body portion 40 is threaded and is received in a threaded opening 42 in the slide member 20. The body portion 40 or the entire actuator 26 may alternatively be considered to comprise a lock portion used to lock the slide member 20 to the barrel 28, which will be described in more detail later.

In one embodiment, the actuator member 26 is constructed and arranged to be rotatable to selectively lock or release the sliding member 20. In the locked position, the sliding member 20 is prevented from being slideable within the knife body 12, and in an unlocked position, the sliding member 20 is permitted to be slideable within the knife body 12 (e.g., in the barrel 28). In one embodiment, the distal end of the body portion 40 of the actuator member 26 is constructed and arranged to contact the second side 46 of the barrel 28 when the slide member 20 is in the locked position. Grooves, notches, or other indentations may be formed on the head portion 39 to facilitate the rotation of the actuator member 26. An elastomer coating may optionally be provided on the head portion 26 to facilitate the rotation thereof.

As further shown in FIG. 1*a*, an opening 34 may be provided near or at the second end 16 of the knife 10. The opening 34 may be used to loop an attachment device, such as a carabiner, therethrough to attach the knife 10 to a person or object. The location and shape of the opening 34 may vary in other embodiments.

Referring to FIG. 1*b*, the slide member 20 may include a protruding portion 48 on a side of the slide member 20 opposite the side on which the blade assembly 22 is mounted. The barrel 28 may include a recess 50 toward the forward end thereof and constructed and arranged to receive the protruding portion 48 of the slide member 20 when the blade assembly 22 is to be released from the slide member 20, which will be described in more detail later.

Figure 2A:
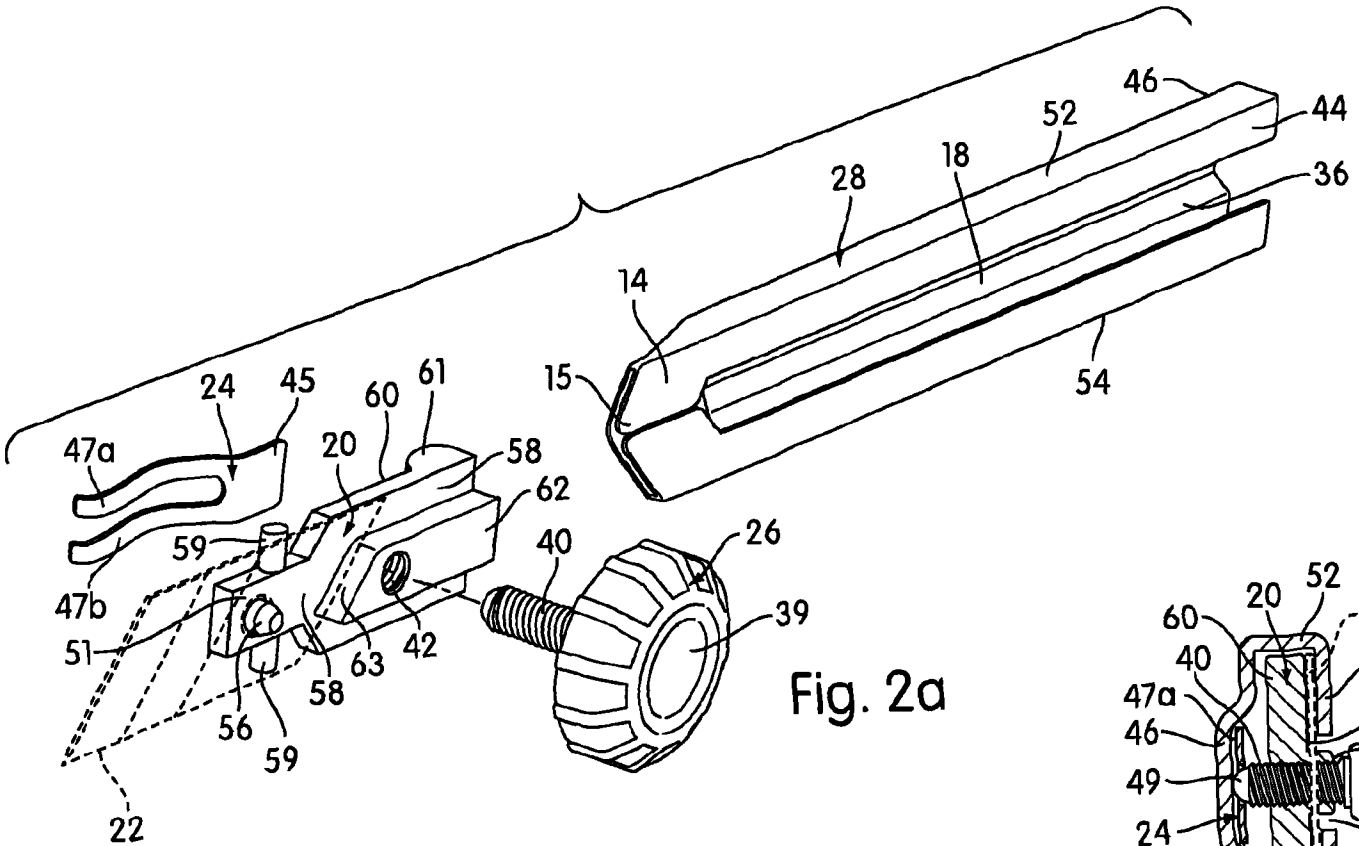
FIG. 2*a* is an exploded view of the various components of the knife assembly in accordance with the embodiment shown in FIG. 1*a;*

FIG. 2*a* is an exploded view of the knife 10. In the embodiment shown in FIG. 2*a*, the barrel 28 includes the first side 44, the second side 46, a top side 52, and a bottom side 54 defining the interior space 18. The top and bottom sides 52, 54 are constructed and arranged to join with the first side 44 and the second side 46.

Figure 2B:
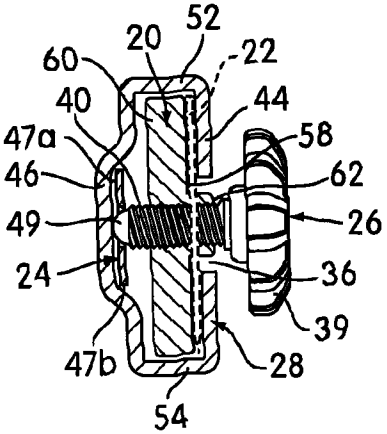
FIG. 2*b* is a cross sectional view of the knife assembly in accordance with the embodiment shown in FIG. 1*a;*

In this embodiment, a bias member 24 takes the form of a leaf spring having a main portion 45 and two prongs 47*a* 47*b*. In this embodiment, the slide member 20 includes the blade engagement structure 56, which takes the form of a post in this embodiment, that is constructed and arranged to be received in the opening 31 of the blade assembly 22 so as to engage the blade assembly 22 with the slide member 20. The blade engagement structure 56 may be formed on a front portion 51 of the slide member 20. A pair of projections 59 may extend in opposite directions on the front portion 51 of the slide member 20. However, these projections 59 are optional and are not provided in some embodiments. The slide member 20 may include a first side surface 58 and a second side surface 60. As shown in FIG. 2*b*, when the slide member 20 is assembled in the knife body 12, the first side surface 58 of the slide member 20 may face the first side 44 of barrel 28 and the second side surface 60 of the slide member 20 may face the second side 46 of the barrel 28. The bias member 24 is disposed between the second side 46 of the barrel 28 and the second side surface 60 of the slide member 20. The prongs 47*a*, 47*b* of the bias member 24 may be constructed and arranged to contact the second side 46 of the barrel 28.

Referring back to FIG. 2*a*, an elevated front surface 62 may be provided on the first side surface 58 of the slide member 20. In one embodiment, the elevated front surface 62 may be received in the opening 36 of the barrel 28. Alternatively, the elevated front surface 62 may optionally be constructed and arranged to abut against the body portion 30 when the slide member 20 is in the locked position. Furthermore, when the slide member 20 is in the locked position, an end portion 49 of the threaded portion 40 of the actuator member 26 may abut against the second side 46 of the barrel 28. In addition, a portion of the first side surface 58 of the slide member 20 may abut against the first side 44 of the barrel 28 when the slide member 20 is in the locked position. Thus, the contact between the end portion 49 of the threaded portion 40 and the second side 46 of the barrel 28 and/or the contact between the first side surface 58 of the slide member 20 and the first side 44 of the barrel 28 may provide sufficient friction so as to prevent sliding movement of the slide member 20. Thus, to lock the sliding position of the blade assembly 22, the actuator 26 is tightened until the end portion 49 of the threaded portion 40 engages the surface of the second side 46, and continued tightening causes the slide member 20 to move towards the first side 44 by virtue of the threaded engagement between the threaded opening 42 in the slide member 20 and the threads on the threaded portion 40. Such continued tightening causes the blade assembly 22 to be clamped between the first side surface 58 of the slide member 20 and the first side 44 of the barrel 28. Such clamping provides added stability to the blade assembly 22 and fixes the longitudinal position thereof. The second side 46 of the barrel 28 may be smooth, although notches or other structures may be provided thereon to facilitate the locking of the slide member 20 so as to prevent sliding movement of the slide member 20 during use of the knife 10. That is, when the knife is in use, friction and/or other structures may be necessary to prevent the slide member 20 and the blade assembly 22 from sliding backwards into the knife body 12 towards the second end 16 of the knife body 12.

The elevated front surface 62 may also include an inclined surface 63 constructed and arranged to engage the rear edge 35 of the blade assembly 22. The inclined surface 63 may facilitate the alignment of the opening 31 of the blade assembly 22 with the blade engagement structure 56 when the blade assembly 22 is being engaged with the slide member 20. That is, when the blade assembly 22 is being engaged with the slide member 20, the rear edge of the blade assembly 22 may abut against the inclined surface 63, thus causing the opening 31 to align with the blade engagement structure 56.

The slide member 20 may also include a curved projection 61 at the rear portion thereof. The curved rear projection 61 may be constructed and arranged to contact the second side 46 of the barrel 28 when the slide member 20 is disposed inside the barrel 28. The projection 61 may optionally act as a fulcrum for the slide member 20 to provide a slight tilting thereof to facilitate full seating of the blade engagement structure or post 56 in the blade assembly opening 31.

Figure 3A:
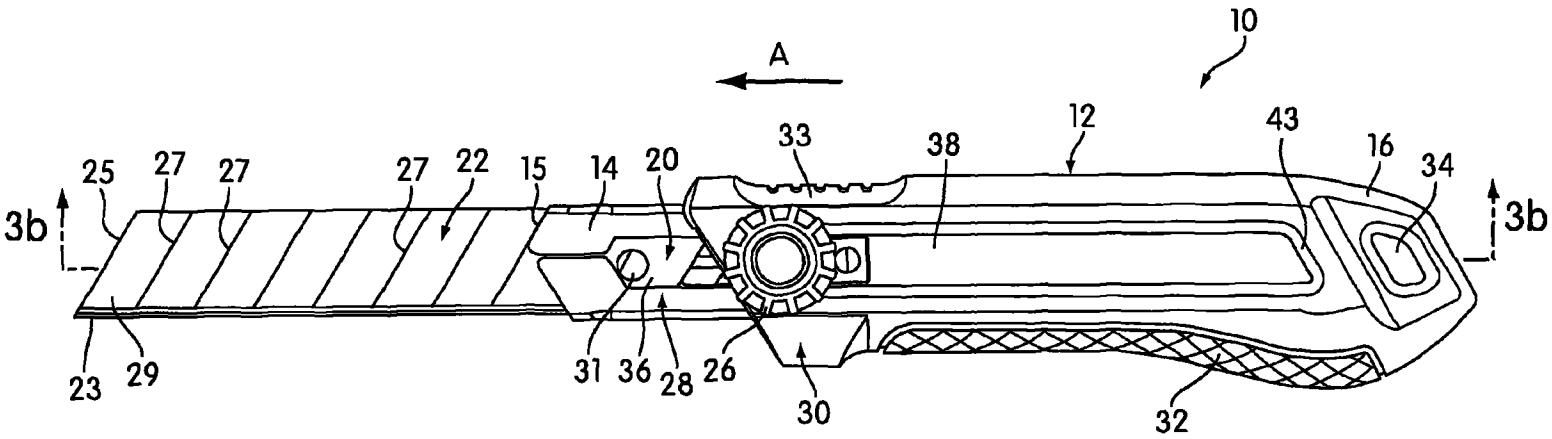
FIG. 3*a* is a side plan view of the knife assembly in a release position and with an actuator in a locked position in accordance with the embodiment shown in FIG. 1*a;*
Figure 3B:
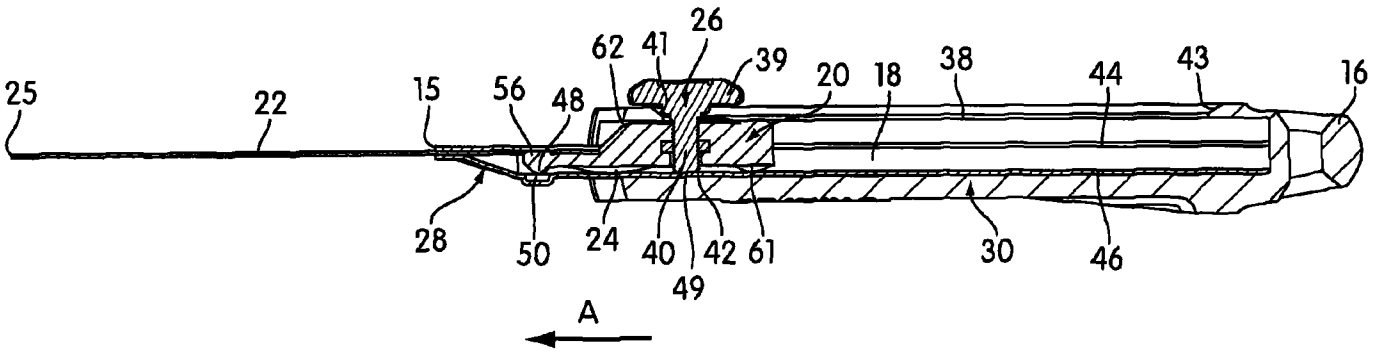
FIG. 3*b* is a cross sectional view of the knife assembly, taken through the line x-x in FIG. 3*a*, in the release position.

FIGS. 3*a* and 3*b* show the blade assembly 22 and the slide member 20 in the release position. In this position, the slide member 20 and the actuator member 26 are positioned near the opening 15 formed in the first end 14 of the knife body 12. At least a portion of the actuator member 26 may abut against the front stop surface 41 of the body portion 30, thus preventing further sliding movement of the slide member 20 and actuator member 26 in the forward direction (i.e., direction of A). The protruding portion 48 of the slide member 20 may be aligned with the recess 50 formed in the barrel 28. As shown in this Figure, the blade engagement structure 56 is engaged with the blade assembly 22, and the blade assembly 22 is retained between at least a portion of the slide member 20 and the first wall 44 of the barrel 28.

Figure 4A:
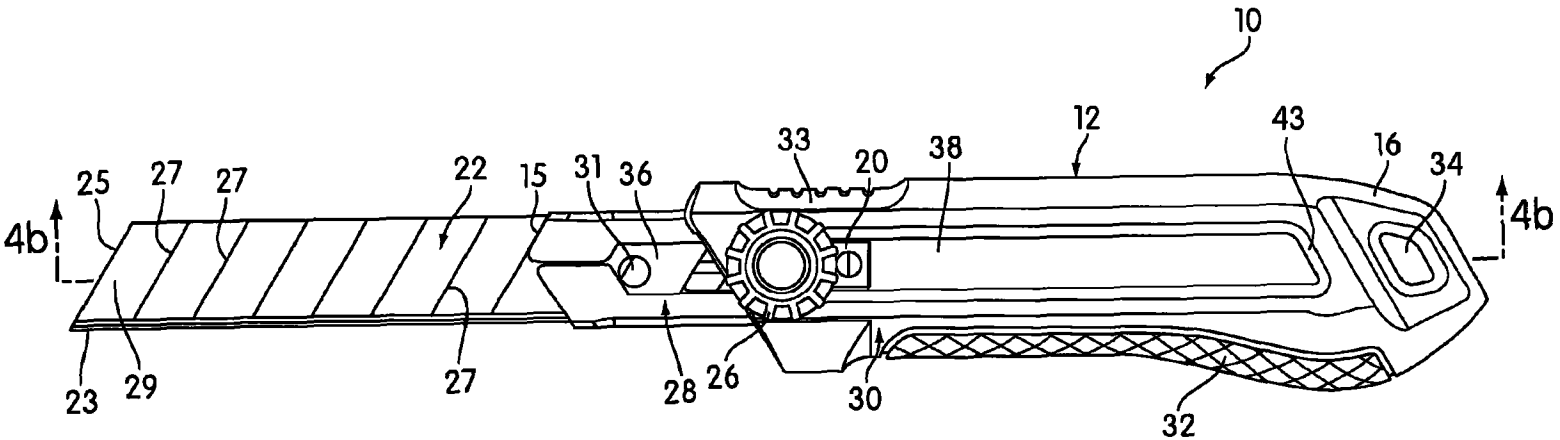
FIG. 4*a* is a side plan view of the knife assembly in the release position and with the actuator in an unlocked position in accordance with the embodiment shown in FIG. 1*a;*
Figure 4B:
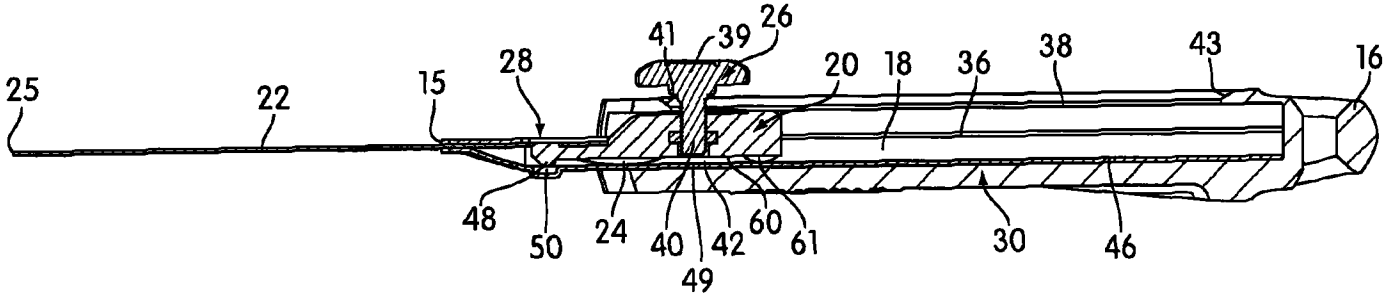
FIG. 4*b* is a cross sectional top view of the knife assembly, taken through the line x-x in FIG. 4*a.*
Figure 5A:
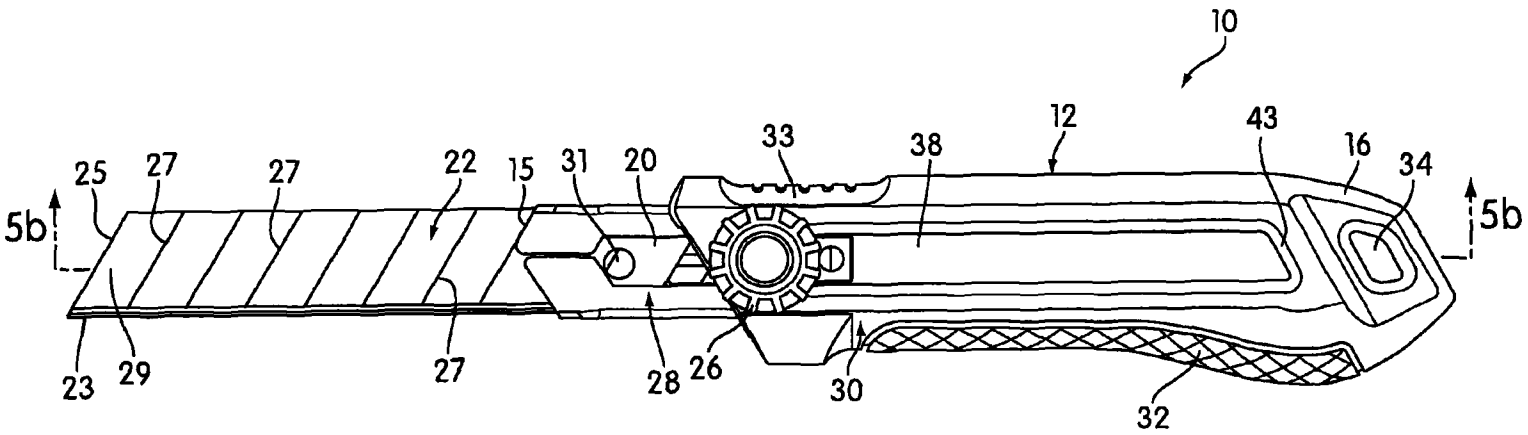
FIG. 5*a* is a side plan view of the knife assembly in a disengaged configuration in accordance with the embodiment of FIG. 1*a;*
Figure 5B:
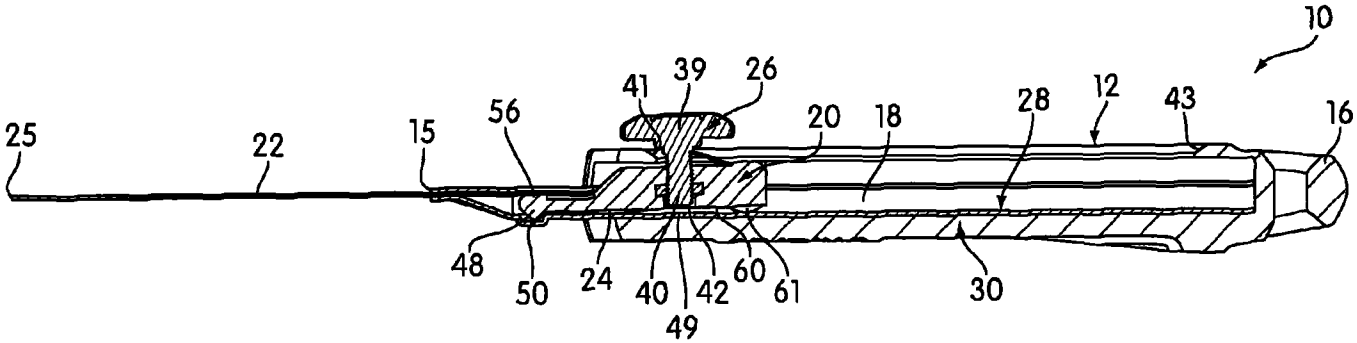
FIG. 5*b* is a cross sectional view of the knife assembly in accordance with another embodiment.

FIGS. 4*a* and 4*b* show the blade assembly 22 and the slide member 20 in the release position and the actuator member 26 rotated (in an unthreading action) to a position wherein the actuator member 26 can be actuated so as to permit the blade assembly 22 to be released from the slide member 20. As shown in this Figure, the actuator member 26 may be rotated such that the body portion 40 of the actuator member 26 is no longer in contact with the second side 46 of the barrel 28. That is, the user may rotate the actuator member 26 using the head portion 39 such that the end portion 49 of the threaded body portion 40 is retracted into the slide member 20 or is flush with the second side surface 60 of the slide member 20. Accordingly, the actuator member 26 may be actuated (e.g., by being pushed inwards) to depress the slide member 20 downwards towards the second side 46 of the barrel 28 against the bias of the bias member 24. FIGS. 5*a*-5*b* show the slide member 20 in the disengaged position after the actuator member 26 has been actuated to disengage the blade assembly 22 from the slide member 20. The protruding portion 48 of the slide member 20 may be received in the recess 50 formed in the barrel 28. As such, the blade holding portion 56 of the slide member 20 is disengaged from the blade assembly 22 when the actuator member 26 is actuated. That is, the blade holding portion 56 of the slide member 20 is removed from the opening 31 of the blade assembly 22. During this action, when actuator 26 is pressed inwardly, the protrusion 61 on the slide member 20 may act as a fulcrum or pivot point, causing the protruding portion 48 of the slide member 20 to move downwardly into the recess 50.

The knife 10 may be operated in accordance with an embodiment as follows. The knife 10 may initially be in the position of use, as shown in FIGS. 1*a*-1*b*. In this position, the slide member 20 is in the locked position wherein the friction from the contact between the end portion 49 of the body portion 40 of the actuator member 26 and the second side 46 of the barrel 28 and the contact between the slide member 20 and the barrel 28 may prevent the slide member 20 and the blade assembly 22 from sliding during use.

To enable the slide member 20 to be slid to another position, such as the release position shown in FIGS. 4*a*-4*b* so that the blade assembly 22 may be replaced, the user may rotate the actuator member 26 using the head portion 39 thereof to move the slide member 20 to the unlocked position. After the actuator member 26 has been "loosened" to the unlocked position such that the actuator member 26 is no longer pushing against the second side 46 of the barrel 28 and the slide member 20 is no longer being forced against the first side 44 of the barrel 28 with sufficient force to overcome the sliding movement, the slide member 20 may be slid by movement of the actuator 26. During the "loosening" of the actuator member 26 to the unlocked position, the actuator member 26 may be rotated using the head portion 39 until the body portion 40 is retracted into the slide member 20 or is flush with the second side surface 60 of the slide member 20, as shown in FIG. 4*b*. To release the blade assembly 22, the slide member 20 may be slid in the direction of A, towards the release position. The contact between the first stop surface 41 of the body portion 30 and the head portion 39 and/or the body portion 40 of the actuator member 26 may prevent further movement of the slide member 20 and the actuator member 22 in the direction of A. In this embodiment, the blade assembly 22 may only be released from the slide member 20 when the blade assembly 22 is at the release position (i.e., the forward most position). That is, the actuator 26 may be depressed only when the slide member 20 is moved to the forward most position so that the blade assembly 22 is positioned at the release position, as shown in FIG. 4*b*. However, it is contemplated that in other embodiments, other arrangements are possible and the blade assembly 22 may be released when the blade assembly 22 is at other positions.

In the embodiment shown in FIG. 4*b*, when the actuator member 26 is in the unlocked position, the body member 40 is no longer preventing the slide member 20 from being depressed downward to the disengaged position. The user may then actuate the actuator member 26 using the head portion 39 thereof. As a result, the slide member 20 is also depressed downward towards the second side 46 of the barrel 28 against the bias of the bias member 24. The downward depression of the slide member 20 may compress the bias member 24, as shown in FIG. 5*b*. As mentioned above, the slide member 20 includes the curved projection 61. In one embodiment, as described above, the curved projection 61 may serve as the pivot point for the slide member 20. That is, when the slide member 20 is depressed downwards due to the actuation of the actuator member 26, the slide member 20 may be moved downwards and pivoted about the curved projection 61 such that the protruding portion 48 of the slide member 20 is received in the recess 50 formed in the barrel 28 and a portion of the second side surface 60 of the slide member 20 abuts against the second side 46 of the barrel 28. As shown in FIG. 5*b*, when the actuator member 26 is actuated such that the protruding portion 48 of the slide member 20 is received in the recess 50 formed in the barrel 28, the blade engagement structure 56 of the slide member 20 is removed from the opening 31 of the blade assembly 22 and the slide member 20 may be spaced from the blade assembly 22. That is, the slide member 20 is no longer pushing the blade assembly 22 against the first side 44 of the barrel 28. Thus, the blade assembly 22 is permitted to be removed from the barrel 28 through the opening 15. It should be appreciated that actuating the actuator member 26 may include one or both or any combination of the steps of rotating the actuator member 26 and/or depressing the actuator member 26.

To replace the blade assembly 22, a new blade assembly 22 may be inserted into the opening 15 in the barrel 28. After the new blade assembly 22 has been inserted, the opening 31 of the blade assembly 22 may be aligned with the blade engagement structure 56 of the slide member 20. The user may then cease actuation of the actuator member 26, whereupon the bias member 24 may bias the slide member 20 upwards towards the first side 44 of the barrel 28 such that the blade engagement structure 56 of the slide member 20 is inserted into the opening 31 of the blade assembly 22, thus engaging the blade assembly 22 to the slide member 20, as shown in FIG. 4*b*. The user may then slide the slide member 20 using the actuator member 26 to a desired position.

After the desired position of the slide member 20 has been reached, the user may then rotate the actuator member 26 clockwise to move the slide member 20 to the locked position, as shown in FIG. 1*a*-1*b*. That is, the user may rotate the actuator member 26 using the head portion 39 such that the body portion 40 thereof is engaged with and pushing against the second side 46 of the barrel 28. As a result, the slide member 20 is pushed upwards such that the slide member 20 is engaged with or pushing against the first side 44 of the barrel 28 and/or the body portion 30. As mentioned above, the contact between the body portion 40 of the actuator member 26 and the second side 46 of the barrel 28 and the contact between the slide member 20 and the barrel 28 may provide sufficient friction to prevent sliding movement of the slide member 20. Thus the slide member 20 is in the locked position and the blade assembly 22 is ready to be used. In addition to using the actuator member 26 to release the blade assembly 22, the actuator member 26 may also be used to slide the slide member 20 to a desired position such that the front edge 25 of the blade assembly 22 is extended for use or the blade assembly 22 is retracted into the body 12 for storage.

Figure 6A:
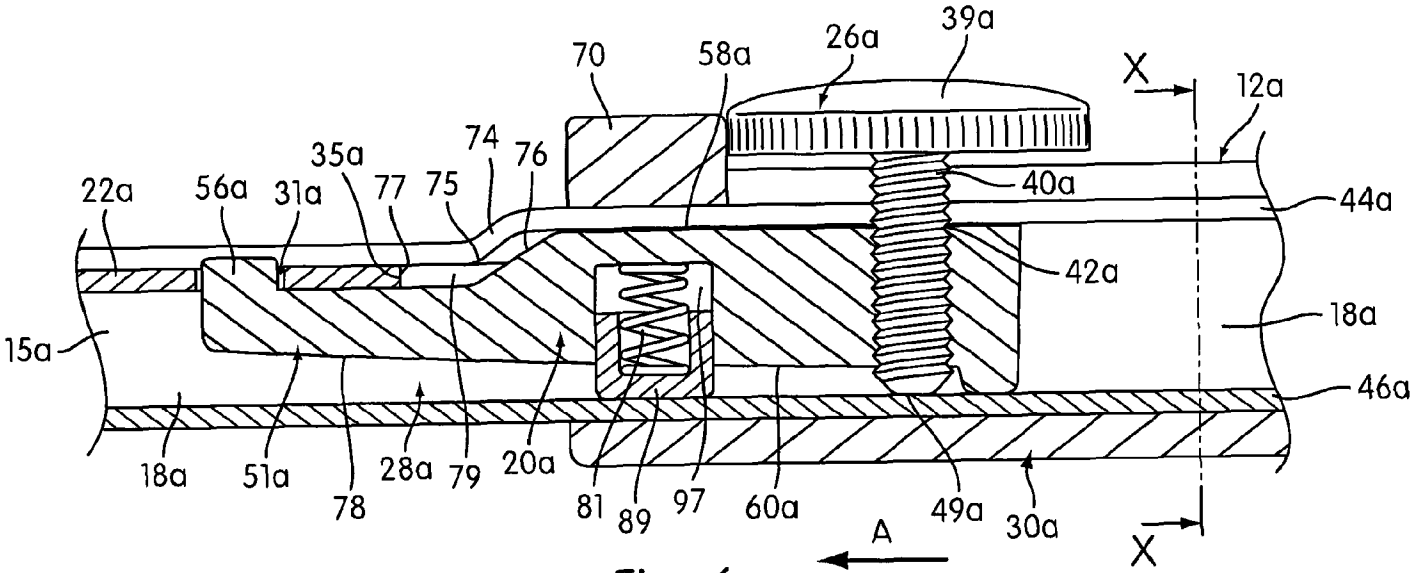
FIG. 6*a* is a side cross sectional view of the knife assembly in accordance with another embodiment.

FIG. 6*a* shows an alternative embodiment of the knife 10*a*. This embodiment of the knife 10*a* may have similar features as the embodiment shown in FIGS. 1-5*b*. Accordingly, the similar features will be labeled with the same numerals, but with an "a" appended thereto.

Figure 6B:
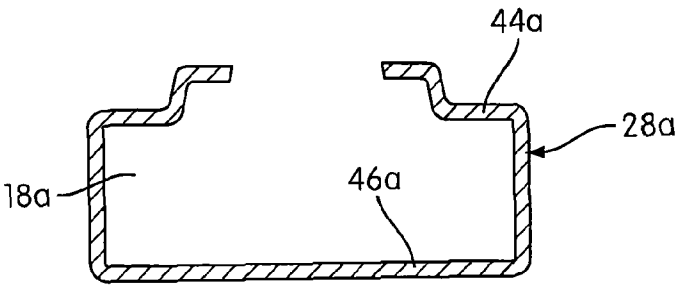
FIG. 6*b* is a cross sectional view of the barrel, taken through line x-x of the embodiment of FIG. 6*a;*

In the illustrated embodiment, the knife 10*a* includes the knife body 12*a*, which includes the barrel 28*a* and the body portion 30*a*. A cross section of the barrel 28*a* (only), taken through the line x-x in FIG. 6*a*, is shown in FIG. 6*b*. The barrel 28*a* includes the interior space 18*a* defined between the first side 44*a* and the second side 46*a* of the barrel 28*a*. Referring back to FIG. 6*a*, the knife 10*a* also includes the slide member 20*a* which is constructed and arranged to slide within the interior space 18*a* of the barrel 28*a*. The slide member 20*a* is constructed and arranged to engage the blade assembly 22*a* so as to retain at least a portion of the blade assembly 22*a* within the knife body 12*a*. In the illustrated embodiment, when the blade assembly 22*a* is engaged with the slide member 20*a*, the blade engagement structure 56*a* of the slide member 20*a* is received in the opening 31*a* of the blade assembly 22*a*. The slide member 20*a* can be slid along the interior space 18*a* of the barrel 28*a* to retract the blade assembly 22*a* or move the blade assembly 22*a* forward in the direction of A.

In the embodiment shown in FIGS. 6*a* and 6*b*, the interior space 18*a* is defined between the first side 44*a* and the second side 46*a* of the barrel 28*a*. When the slide member 20*a* is in the locked position, the end portion 49*a* of the actuator member 26*a* is constructed and arranged to force against the second side 46*a* of the barrel 28*a* so as to lock the slide member 20 from sliding movement. Furthermore, the slide member 20*a* may also contact the first side 44*a* of the barrel 28 when the slide member 20*a* is in the locked position. In this embodiment, the first side 44*a* of the barrel 28*a* is provided with an elevated stop structure 70 constructed and arranged to abut against the head portion 39*a* of the actuator member 26*a* to prevent further sliding movement of the slide member 20*a* and the actuator member 26*a* in the direction of A.

The slide member 20*a* may also include the threaded opening 42*a* constructed and arranged to receive the actuator 26*a*. To lock the sliding position of the blade assembly 22*a*, the actuator 26*a* may be tightened until the end portion 49*a* of the threaded portion 40*a* engages the surface of the second side 46*a*, and continued tightening causes the slide member 20*a* to move towards the first side 44*a* by virtue of the threaded engagement between the threaded opening 42*a* in the slide member 20*a* and the threads on the threaded portion 40*a*. Such continued tightening causes the blade assembly 22*a* to be clamped between the first side surface 58*a* of the slide member 20*a* and the first side 44*a* of the barrel 28*a*. Such clamping provides added stability to the blade assembly 22*a* and fixes the longitudinal position thereof. It is also contemplated that in some embodiments, notches, grooves, or other structures may be provided to facilitate the locking of the slide member 20*a* in the locked position.

The first side 44*a* of the barrel 28*a* may include, at a forward portion thereof, a slanted stop surface 74 and an edge surface 75 adjacent the slanted stop surface 74. The slanted stop surface 74 may be positioned between the elevated stop structure 70 and the opening 15*a* of the knife body 12*a*. The slide member 20*a* may include a slanted upper surface 76 constructed and arranged to contact the slanted stop surface 74 and the edge surface 75 when the slide member 20 is pushed towards the opening 15*a*, which will be described in more detail later. The second side surface 60*a* of the slide member 20*a* may also include an inclined rear surface portion 78, which in this embodiment is formed on the narrow front portion 51*a* of the slide member 20. The inclined rear surface portion 78 may be spaced from or extend away from the second side 46*a* of the barrel 28*a*. A biasing member 81, which takes the form of a spring in this embodiment, may be provided on the second side surface 60*a*. The biasing member 81 may be constructed and arranged to bias the slide member 20*a* in the engaged position. A biasing member receiving structure 89 (which can, in one sense, be considered as part of the biasing member 81) may be provided to help retain at least a portion of the biasing member 81 in a recess 97 formed in the slide member 20*a*. The biasing member receiving structure 89 may be constructed and arranged to have an engaging surface thereof that contacts the second side 46*a* of the barrel 28*a*, or in another embodiment, the biasing member 81 may optionally contact the second side 46*a* directly.

The knife 10*a* may operate in accordance with an embodiment as follows. The user may rotate the head portion 39*a* of the actuator member 26*a* so that the end portion 49 thereof moves away from the second side 46*a* to enable the slide member 20*a* to be unlocked so that the slide member 20*a* can be slid to retract the blade assembly 22*a* or move the blade assembly 22*a* forwardly in the direction of A. By rotating the head portion 39*a* of the actuator member 26*a*, the actuator member 26*a* may be "loosened" such that the body portion 40*a* is no longer pushing against the second side 46*a* of the barrel 28*a* and the slide member 20*a* is no longer pushing against the first side 44*a* of the barrel 28*a* with enough force to prevent the sliding movement of the slide member 20*a*. Accordingly, the slide member 20*a* may be moved in the direction of A or in the direction opposite that of A.

To remove and replace the blade assembly 22*a*, the slide member 20*a* may be slid to the release position, as shown in FIG. 6*a*. In this embodiment, the body 12*a* has an elevated stop structure 70 that prevents the actuator member 26*a* from moving to the release position unless it is sufficiently unscrewed or released. Specifically, during normal use, the contact between the elevated stop structure 70 and the head portion 39*a* of the actuator member 26*a* may prevent further sliding movement of the slide member 20*a* in the direction of A. When the blade assembly 22*a* is to be replaced, the user may rotate the actuator member 26*a* using the head portion 39*a* until the head portion 39*a* is moved outwardly enough to clear the elevated stop structure 70 (i.e., the head portion 39*a* is positioned higher than the elevated stop structure 70). In one embodiment, when the head portion 39*a* has cleared the elevated stop structure 70, the distal end portion 49*a* of the body portion 40*a* of the actuator member 26*a* may be flush with the second side surface 60*a* of the slide member 20*a* or may be retracted into the slide member 20*a*. Once the head portion 39*a* has cleared the elevated stop structure 70 and the elevated stop structure 70 is no longer blocking the further sliding movement of the slide member 20*a* in the direction of A, the user may then push the slide member 20*a* in the direction of A. When the slide member 20*a* is pushed in the direction of A, the slanted upper surface 76 of the slide member 20*a* pushes against the slanted stop surface 74 and the edge surface 75. Accordingly, the slanted stop surface 74 and the edge surface 75 pushes or cams the slide member 20*a* (or at least the forward portion thereof) downwards towards the second side 46*a* of the barrel 28*a* against the bias of the biasing member 81. As a result, the biasing member receiving structure 89 is moved further into the recess 97 formed in the slide member 20*a* and the narrow front portion 51*a* is moved closer to the second side 46*a* of the barrel 28*a*. Accordingly, the blade engagement structure 56*a* is removed from the opening 31*a* of the blade assembly 22*a*. Thus, the slide member 20*a* is in the disengaged position and the blade assembly 22*a* can be removed from the knife body 12*a* via the opening 15*a*.

A new blade assembly 22*a* can then be inserted into the knife body 12*a* through the opening 15*a* until the rear edge 35*a* of the blade assembly 22*a* contacts a forward stop surface 77 formed on a projection 79 extending from the slanted upper surface 76. In other embodiments, the forward stop surface 77 may be defined on the slanted upper surface 76 rather than on a projection or separate structure. The forward stop surface 77 may be used to facilitate the alignment of the opening 31*a* of the blade assembly 22*a* with the blade engagement structure 56*a*. That is, when the blade assembly 22*a* is being engaged with the slide member 20*a*, the forward stop surface 77 may abut against the rear end 35*a* of the blade assembly 22*a* so that the opening 31*a* is aligned with the blade engagement structure 56*a*. The slide member 20*a* may then be retracted into the barrel 28*a* by the sliding movement thereof in the opposite direction of A until the head portion 39*a* of the actuator member 26*a* is positioned to the side of the stop structure as shown in FIG. 6*a*. Accordingly, the slanted upper surface 76 of the slide member 20*a* is removed from engagement with the edge surface 75 and the slanted stop surface 74, whereupon the biasing member 81 snaps the slide member 20*a* to the engaged position such that the blade engagement structure 56*a* is received in the opening 31*a* of the blade assembly 22*a*. The body portion 40*a* of the actuator member 26*a* may then be tightened to the locked position.

Figure 7:
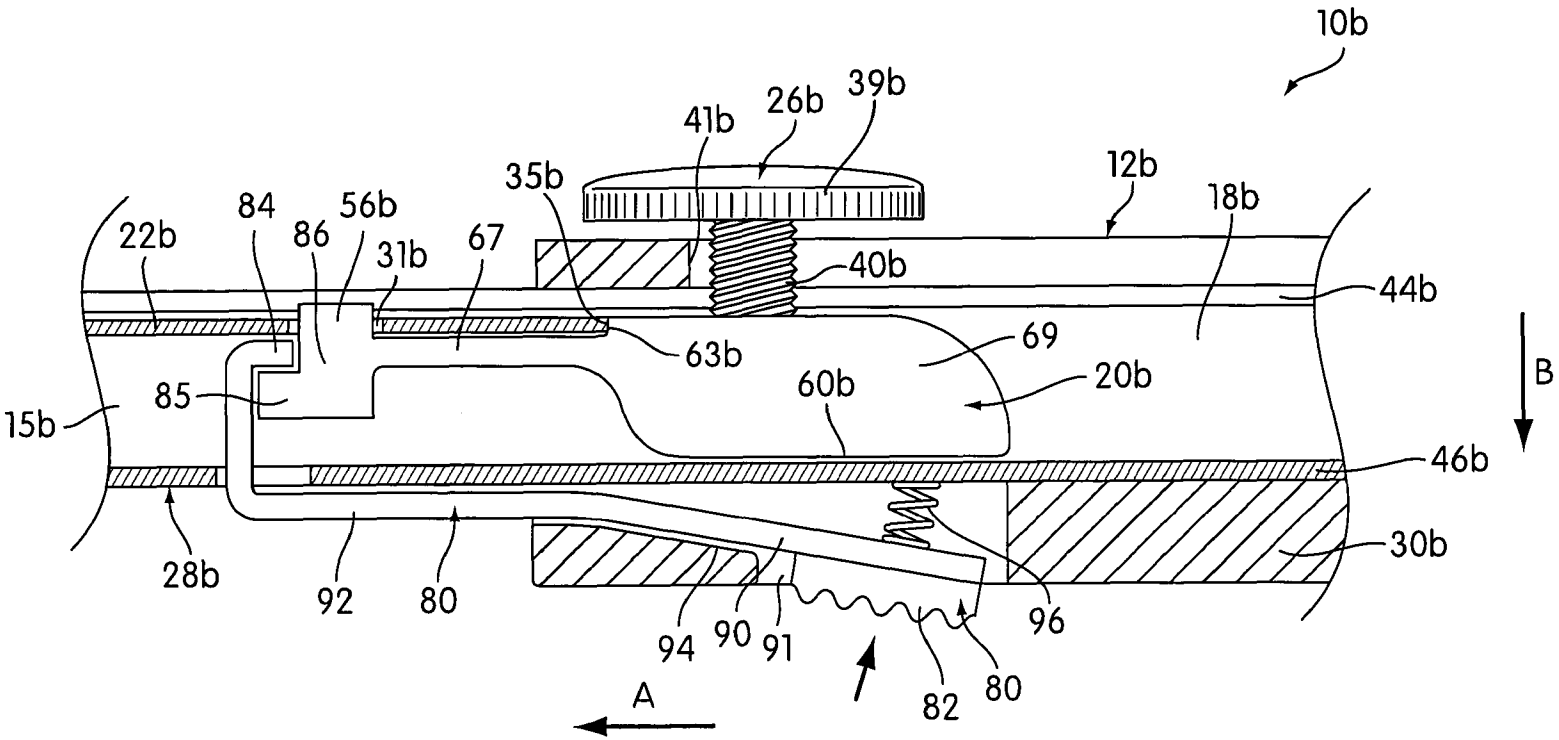
FIG. 7 is a side cross sectional view of the knife assembly in accordance with yet another embodiment.

FIG. 7 shows another embodiment of the knife 10*b*. This embodiment of the knife 10*b* may have similar features as the embodiment shown in FIGS. 1-5*b*. Accordingly, the similar features will be labeled with the same numerals, but with a "b" appended thereto.

In the illustrated embodiment, the knife 10*b* includes the knife body 12*b*, which includes the barrel 28*b* and the body portion 30*b*. The knife 10*b* also includes the slide member

20*b* which is constructed and arranged to slide within the interior space 18*b* of the barrel 28*b*. The slide member 20*b* is constructed and arranged to engage the blade assembly 22*b* so as to retain at least a portion of the blade assembly 22*b* within the knife body 12*b*. In the illustrated embodiment, when the blade assembly 22*b* is engaged with the slide member 20*b*, the blade engagement structure 56*b* of the slide member 20*b* is received in the opening 31*b* of the blade assembly 22*b*. When the slide member is in the unlocked position, the slide member 20*b* can be slid along the interior space 18*b* of the barrel 28 to retract the blade assembly 22*b* or move the blade assembly 22*b* forward in the direction of A. When the slide member 20*c* is in the locked position, the sliding movement of the slide member 20*c* is prevented. The threaded slide actuator 26*b* may be rotated to move the slide member 20*c* between the locked and unlocked positions.

As shown in the illustrated embodiment of FIG. 7, the slide member 20*b* has a main portion 69 that receives the slide actuator 26*b*, a front portion 86 where the blade engaging structure 56*b* is located, and an extending portion 67 that connects the main portion 69 with the front portion 86. The extending portion 67 may be made of flexible plastic. In one embodiment, the slide member 20*b* may be made entirely of plastic. The slide member 20*b* may also include a front surface 63 constructed and arranged to facilitate the alignment of the opening 31*b* of the blade assembly 22*b* with the blade engagement structure 56*b* during the replacement of the blade assembly 22, which will be described in more detail later. The body portion 30*b* may include the first stop surface 41*b* constructed and arranged to abut against a portion of the slide actuator member 26*b* to prevent further sliding movement of the slide member 20*b* and the slide actuator member 26*b* in the direction of A.

In the illustrated embodiment, the knife 10*b* includes a separate release actuator 80 constructed and arranged to facilitate the disengagement of the blade assembly 22*b* from the blade engagement structure 56*b* of the slide member 20*b*. The release actuator 80 has a contact portion 82 at one end and an extension 84 on the other end. An opening 91 may be provided in the body portion 30 to receive the contact portion 82. Ridges or other shapes may be provided on the contact portion 82 to provide friction on the surface thereof. The extension 84 is constructed and arranged to contact the front portion 86 of the slide member 22*b* above a protrusion 85 extending from the front portion 86. In the illustrated embodiment, the release actuator 80 has an angled portion 90 adjacent a flat portion 92. The angled portion 90 is constructed and arranged to be disposed against a slanted inner surface 94 of the body portion 30*b*. A bias member 96, which takes the form of a compression spring 96 in this embodiment, may be provided between the contact portion 92 and the second side 46*b* of the barrel 28*b* to bias the angled portion 90 into contact with the inner surface 94. The portions 90, 92, and 84 may be flexible, or in another embodiment, may be rigid. These portions 90, 92, and 84 can be made, for example, from metal or plastic material.

The knife 10*b* may operate in accordance with an embodiment as follows. The slide member 20*b* may be moved between the locked and unlocked positions similar to the slide member 20, 20*a* described above. After the slide member 20*b* has been moved to the unlocked position by loosening the threaded slide actuator 26*b*, the slide actuator 26*b* can be moved forwardly so that the slide member 20*b* connected to slide actuator 26*b* is pushed to the release position, as shown in FIG. 7. As mentioned above, the first stop surface 41*b* of the body portion 30*b* prevents further sliding movement of the slide member 20*b* in the direction of A.

To disengage the blade assembly 22*b*, the user may depress the contact portion 82 of the release actuator 80 against the bias of the bias member 96. This may cause the flat portion 92 of the blade release structure 80 to be pivoted downwards in the direction of B, which effects the downward movement of the attaching portion 84 in the downward direction of B. Because the attaching portion 84 is in contact with the front portion 86 of the slide member 20*b* and is disposed above the protrusion 85 of the front portion 86, the movement of the attaching portion 84 in the direction of B causes the front portion 86 to move in the direction of B. As such, depressing the blade release structure 80 pulls the front portion 86 of the slide member 20*b* downward. Thus, when the release actuator 80 is depressed, the slide member 20*b* flexes at the middle portion 67 so that the front portion 86 can be pulled downward. As a result, the slide member 20*b* is moved to the disengaged position wherein the blade engagement structure 56*b* is removed from the opening 31*b* of the blade assembly 22*b*. Thus, the blade assembly 22*b* is disengaged from the slide member 20*b*. The blade assembly 22*b* may then be removed from the knife body 12*b* through the opening 15*b*. A new blade assembly 22*b* may then be inserted into the knife body 12*b* through the opening 15*b*. In one embodiment, the rear edge 35*b* of the blade assembly 22*b* may abut against the front surface 63*b* of the slide member 20*b* during insertion, thus aligning the opening 31*b* in the blade assembly 22*b* with the blade engagement structure 56*b*.

After the new blade assembly 22*b* has been inserted into the knife body 12*b*, the user may let go or cease actuation of the contact portion 82, whereupon the bias member 96 may snap the slanted surface 90 of the release actuator 80 towards the slanted surface 94 of the body portion 30*b*. As a result, the flat portion 92 of the release actuator 80 may be moved towards the second side 46*b* of the barrel 28*b* and the attaching portion 84 may be moved upwards towards the first side 44*b* of the barrel 28*b*. As a result, the main portion 67 may flex upwards, thus moving the front portion 86 of the slide member 20*b* and the blade engagement structure 56*b* of the slide member 20*b* upwards towards the first side 44*b* of the barrel 28*b*. Accordingly, the blade engagement structure 56*b* of the barrel 28*b* is inserted into the opening 31*b* of the blade assembly 22*b* and the slide member 20*b* is returned back to its position shown in FIG. 7.

Figure 8A:
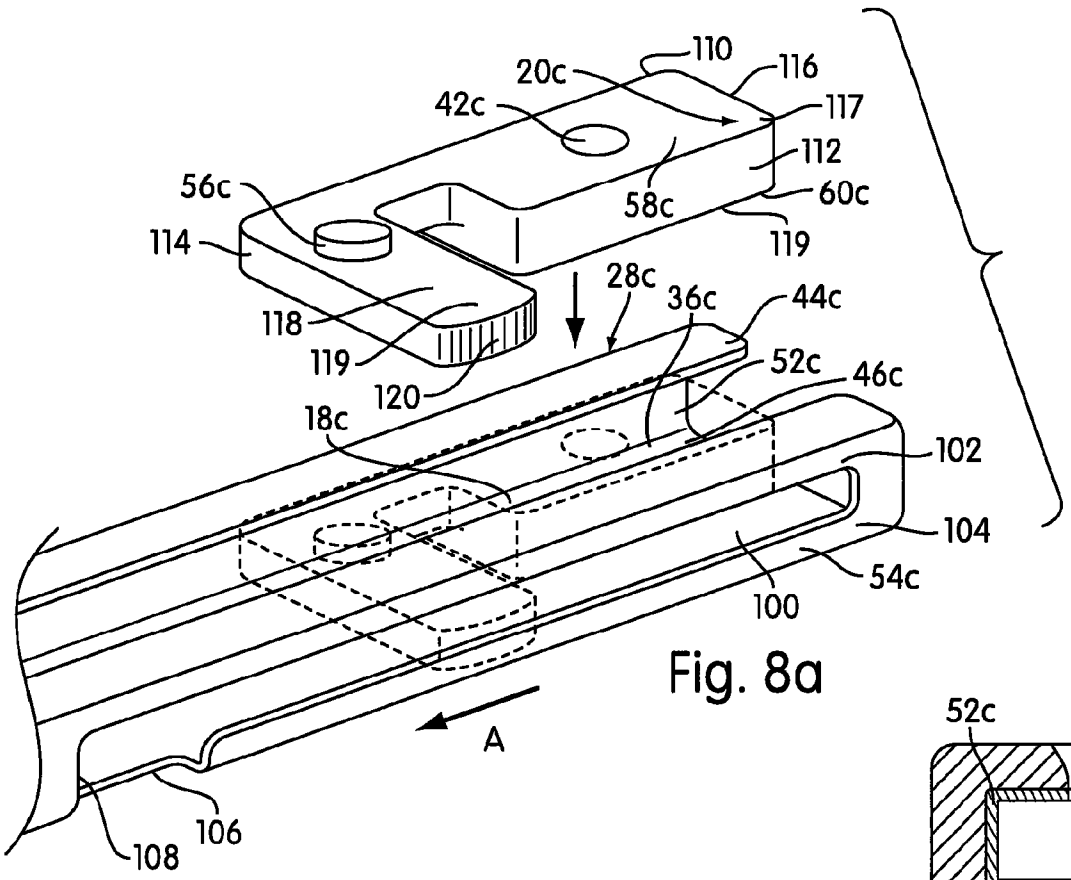
FIG. 8*a* is an exploded view of the knife assembly in accordance with still another embodiment.
Figure 8B:
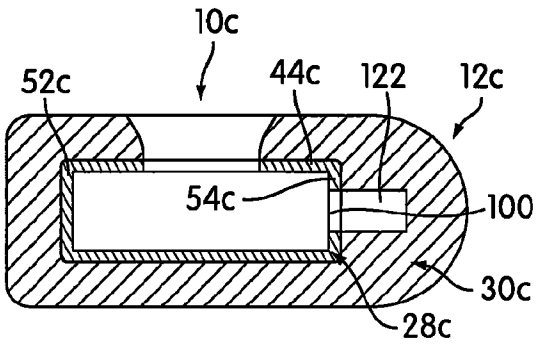
FIG. 8*b* is a cross sectional view of a knife body of the knife assembly, taken through line Y-Y in FIG. 8*c*, in accordance with the embodiment shown in FIG. 8*a*.
Figure 8C:
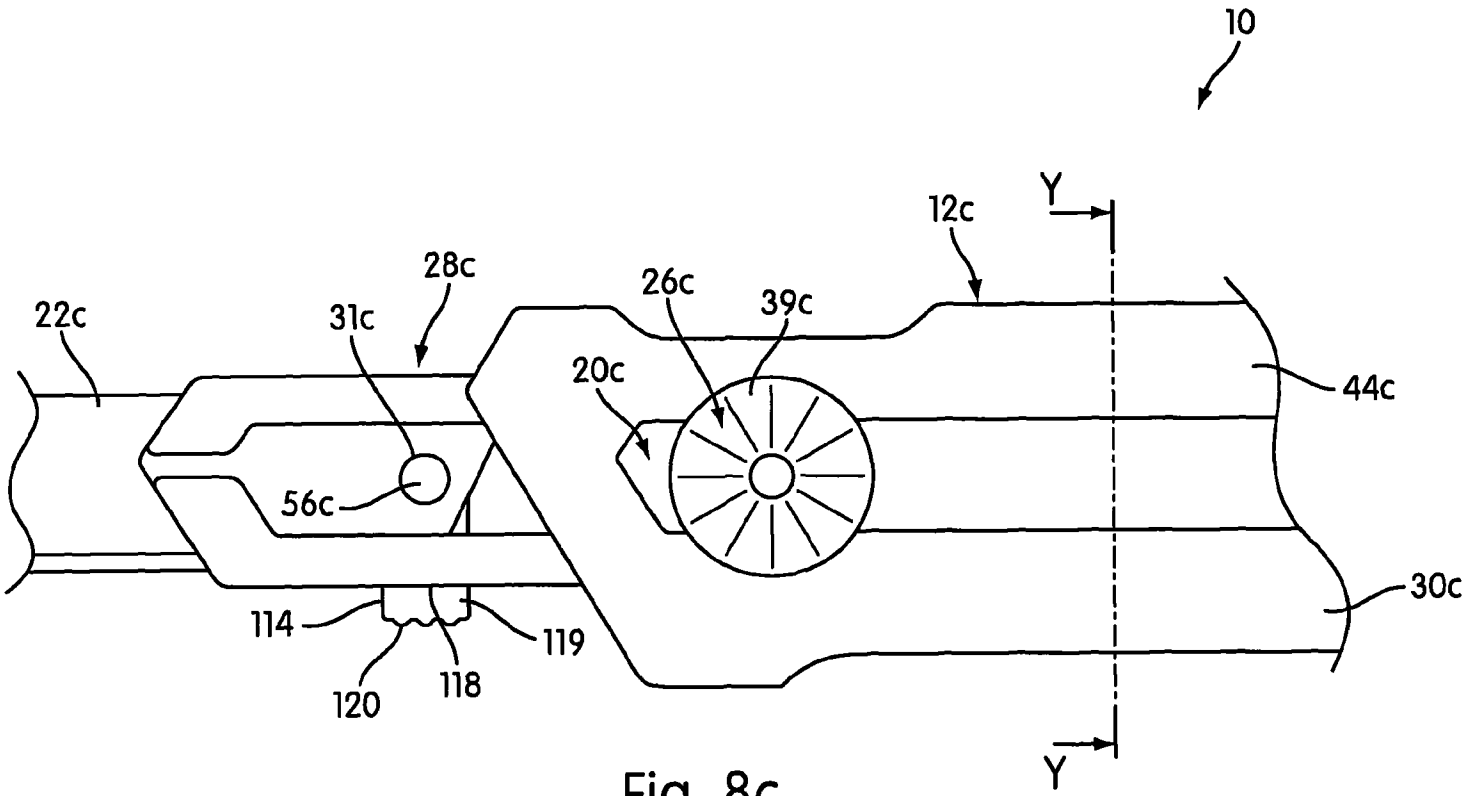
FIG. 8*c* is a side plan view of the knife assembly in accordance with the embodiment shown in FIG. 8*a.*

FIGS. 8*a*, 8*b*, and 8*c* show another embodiment of the knife 10*b*. This embodiment of the knife 10*b* may have similar features as the embodiment shown in FIGS. 1-5*b*. Accordingly, the similar features will be labeled with the same numerals, but with a "c" appended thereto.

In the embodiment shown in FIG. 8*c*, the knife 10*c* includes the knife body 12*c*, which includes the barrel 28*c* and the body portion 30*c*. The knife 10*c* also includes the slide member 20*c* which is constructed and arranged to slide within the interior space 18*c* (see FIG. 8*a*) of the barrel 28*c*. The slide member 20*c* is constructed and arranged to engage the blade assembly 22*c* so as to retain at least a portion of the blade assembly 22*c* within the knife body 12*c*. In the embodiment shown in FIG. 8*c*, when the blade assembly 22*c* is engaged with the slide member 20*c*, the blade engagement structure 56*c* of the slide member 20*c* is received in the opening 31*c* of the blade assembly 22*c*.

Referring to FIG. 8*a*, the slide member 20*c* may be received in the barrel 28*c* as shown in the dashed lines. In this embodiment, the slide member 20*c* includes a top side 110, a bottom side 112, a left side 114, a right side 116, a front side 117, and a rear side 119. The slide member 20*c* may also include a release actuator 118 constructed and arranged to extend further than the bottom side 112. The release actuator

118 may be integrally formed as part of the slide member 20*c*, or can be a separate component. The release actuator 118 may be provided with a bottom surface 120 and an actuation surface 119. In one embodiment, the actuation surface 119 is constructed and arranged to enable the user to actuate the actuation surface 119 to move the slide member 20*c* to the disengaged position so that the blade assembly 22*c* is removed from engagement therewith. The blade engagement structure 56*c* may be located on the release actuator 118. Accordingly, in one embodiment, when the blade assembly 22*c* is engaged with the blade engagement structure 56*c*, the blade assembly 22*c* may be disposed between the release actuator 118 and the front side 44*c* of the barrel 28*c*. Grooves or other structures may be provided on the bottom surface 120. A threaded opening 42*c* may be formed in the slide member 20*c* to receive the threaded slide actuator member 26*c* (see FIG. 8*c*). The user may slide the slide member 20*c* along the barrel 28*c* using the slide actuator 26*c*.

In the illustrated embodiment, the barrel 28*c* includes the first side 44*c*, the second side 46*c*, the top side 52*c*, and the bottom side 54*c*. The opening 36*c* may be formed in the first side 44*c* of the barrel 28*c*. An elongated slot 100 may be formed in the bottom side 54*c* of the barrel 28*c* and may be constructed and arranged to receive at least a portion of the slide member 20*c*, such as the release actuator 118 of the slide member 20*c*. Thus, when the slide member 20*c* is disposed within the barrel 28*c*, a portion of the release actuator 118 of the slide member 20*c*, including the contact surface 120 and the actuator portion 119, may protrude through the elongated slot 100. As shown in FIG. 8*b*, a recess 122 may be formed in the body portion 30*c* to receive the portion of the release actuator 118 that protrudes through the slot 100 of the barrel 28*c*. Accordingly, the body portion 30*c* may surround portions of the barrel 28*c* and the release actuator 118 when the slide member 20*c* is retracted into the body portion 30*c*.

The elongated slot 100 of the barrel 28*c* may be located between a first portion 102 and a second portion 104 of the bottom side 54*c*. A recess 106 may be formed in the second portion 104 of the bottom side 54*c*, and a stop surface 108 may be formed in the bottom side 54*c* adjacent the recess 106. The recess 106 may be constructed and arranged to receive the release actuator 118 when the slide member 20*c* is moved by the slide actuator 26*c* to the release position and the actuation surface 119 of actuator 118 is depressed to move the slide member 20*c* to the disengaged position. As shown in FIG. 8*c*, when the slide member 20*c* is in the release position, the release actuator 118 is positioned in the portion of the barrel 28*c* that is outside of the body portion 30*c* and thus is not surrounded by the body portion 30*c*. As such, the user may access the release actuator 118. Referring back to FIG. 8*a*, the stop surface 108 may be constructed and arranged to abut against a portion of the left side 114 of the slide member 20*c* to prevent further sliding movement of the slide member 20*c* in the direction of A.

In one embodiment, the slide member 20*c* may be made of resilient material to allow flexing thereof when the actuator 118 is depressed, so that blade engagement structure 56*c* is moved out of the engagement receiving region or opening in the blade assembly. In one embodiment, a bias member, such as a spring, may be provided on the slide member 20*c* to bias the slide member 20*c* against the first side 44*c* of the barrel 28*c* so as to retain the blade assembly 22*c* between the slide member 20*c* and the first side 44*c* of the barrel 28*c*.

The knife 10*c* may operate in accordance with an embodiment as follows. The slide member 20*c* may be slid along the interior space 18*c* of the barrel 28*c* using the slide actuator 26*c*. For example, the user may push against the slide actuator 26*c* to slide the slide member 20*c* so that the blade assembly 22*c* can be retracted or moved forward (i.e., in the direction of A). However, it is contemplated that in other embodiments, either the slide actuator 26*c* or the release actuator 118 (e.g., the contact surface 120 thereof) can be slid forward or backward when the slide actuator is released or unlocked to permit sliding movement.

To disengage the blade assembly 22*c* from the slide member 20*c*, the slide member 20*c* may be slid by the slide actuator 26*c* to the release position wherein the release actuator 118 of the slide member 20*c* is aligned with the recess 106. The stop surface 108 may abut against the left side 114 of the slide member 20*c* to prevent further sliding movement in the direction of A. To move the slide member 20*c* to the disengaged position, the user may depress or actuate the actuator portion 119 of the slide member 20*c* so that the release actuator 118 is moved closer to the second side 46*c* of the barrel 28*c* and is received in the recess 106. Accordingly, the blade engagement structure 56*c* is removed from the opening 56*c* of the blade assembly 22*c* and the blade assembly 22*c* can be disengaged from the slide member 20*c*. The user may then remove the blade assembly 22*c* from the knife body 12*c* and insert a new blade assembly 22*c* into the knife body 12*c*. After the new blade assembly 22*c* has been inserted into the knife body 12, the user may let go of the actuation surface 119 (i.e., cease actuation of the actuation surface 119). The release actuator 118 may snap upwards towards the first side 44*c* of the barrel 28*c* due to the resiliency of the slide member 20*c* and/or the bias of a bias member. Accordingly, the blade engagement structure 56*c* may be inserted into the opening of the blade assembly 22*c* to engage the blade assembly 22*c* with the slide member 20*c*.

To lock the sliding position of the blade assembly, the actuator may be tightened until the end portion of the threaded portion of the actuator member engages the surface of the second side 46*c*, and continued tightening causes the slide member 20*c* to move towards the first side 44*c* by virtue of the threaded engagement between the threaded opening 42*c* in the slide member 20*c* and the threads on the threaded portion of the actuator. Such continued tightening causes the blade assembly to be clamped between the first side surface 58*c* of the slide member 20*c* and the first side 44*c* of the barrel 28*c*. Such clamping provides added stability to the blade assembly and fixes the longitudinal position thereof. Alternatively or additionally, notches (not shown) may be provided on the second side surface 46*c* of the barrel 28*c* to facilitate the locking of the slide member 20*c* in the locked position.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment may be combined with one or more features of any other embodiment.

What is claimed is:

1. A knife, comprising:

a body having a first end, a second end, and an opening at the first end;

a blade assembly comprising a plurality of releasably attached blade members that can be separated from one another, the blade assembly comprising an engagement opening;

a slide member constructed and arranged to be slideable in the body, the slide member arranged to engage the blade assembly, wherein the slide member includes an engagement structure that is arranged to engage the engagement opening so that the blade assembly moves with the slide member, the slide member being movable to position the blade assembly at a position of use wherein at least one of the blade members has at least a portion thereof that projects froth the opening at the first end, and to position the blade assembly at a release position wherein the blade assembly can be released from the slide member when at the release position, the slide member also movable to retract the blade assembly into the body towards the second end to a retracted position; and an actuator member includes a lock portion that is movable between locked and unlocked positions to selectively lock the slide member so as to prevent the slide member from being slideable within the body, or release the slide member so as to permit the slide member to be slideable within the body, the actuator member is constructed and arranged to be actuated to thereby move the slide member to a disengaged configuration wherein the blade assembly can be disengaged from the slide member to permit the release therefrom;

wherein when the slide member is in the disengaged configuration and the blade assembly is at the release position, the actuator member is constructed and arranged to be pressed inwardly to disengage the engagement structure of the slide member from the engagement opening of the blade assembly to permit the release of the blade assembly from the slide member.

2. The knife of claim 1, further comprising a bias member constructed and arranged to bias the slide member toward an engaged configuration wherein the blade assembly is engaged to the sliding member to prevent release therefrom.

3. The knife of claim 2, wherein the actuator member is constructed and arranged to be actuated to move the slide member against the bias of the bias member to the disengaged configuration.

4. The knife of claim 1, wherein at the release position, the blade assembly is disposed near or at the opening of the first end of the body.

5. The knife of claim 1, wherein the engagement structure is a protrusion.

6. The knife of claim 5, wherein the protrusion is integral with the sliding member.

7. The knife of claim 1, wherein the lock portion is constructed and arranged to be rotatable between the locked and unlocked positions.

8. The knife of claim 1, wherein in the locked position, the lock portion engages a receiving portion of the body of the knife so as to create a clamping force thereon to prevent the sliding member from sliding along the body.

9. The knife of claim 1, wherein the lock portion comprises a threaded surface.

10. The knife of claim 1, wherein the actuator member comprises a rotatable structure.

11. The knife of claim 1, wherein the actuator member is further constructed and arranged to be engageable with the slide member, the actuator member being moveable to move the slide member between the position of use and the retracted position.

12. The knife of claim 1, wherein the actuator member comprises a slide actuator constructed and arranged to facilitate sliding movement of the slide member and a release actuator constructed and arranged to facilitate the release of the blade assembly when the blade assembly is at the release position.

13. A method for replacing the blade assembly of the knife of claim 1, the method comprising:

actuating the actuator member to permit the slide member to be slideable within the body of the knife;

moving the slide member to position the blade assembly at a release position wherein the blade assembly can be released from the slide member; and when the slide member and the blade assembly are at the release position, pressing the actuator member inwardly to disengage an engagement structure of the slide member from an engagement opening of the blade assembly to permit the release of the blade assembly from the slide member.

14. The method of claim 13, wherein actuating the actuator member comprises:

moving the actuator member from the locked position to the unlocked position.

15. The method of claim 13, further comprising a bias member constructed and arranged to bias the slide member toward an engaged configuration wherein the blade assembly is engaged to the sliding member to prevent release therefrom.

16. The method of claim 15, wherein the actuator member is constructed and arranged to be actuated to move the slide member against the bias of the bias member to the disengaged configuration.

17. The method of claim 13, wherein at the release position, the blade assembly is disposed near or at the opening of the first end of the body.

18. The method of claim 13, wherein the engagement structure of the slide member is arranged to engage with the engagement opening of the blade assembly so that the blade assembly moves with the slide member.

19. The method of claim 13, wherein the lock portion is constructed and arranged to be rotatable between the locked and unlocked positions.

20. The method of claim 19, wherein in the locked position, the lock portion engages a receiving portion of the body of the knife so as to create a clamping force thereon to prevent the sliding member from sliding along the body.

21. The method of claim 13, wherein the actuator member is further constructed and arranged to be engageable with the slide member, the actuator member being moveable to move the slide member between the position of use and the retracted position.

* * * * *